US009975611B1

(12) United States Patent
Peterson

(10) Patent No.: US 9,975,611 B1
(45) Date of Patent: May 22, 2018

(54) COCKPIT ASSEMBLIES FOR TOWABLES

(71) Applicant: SDS Asia Limited, BVI #1748971, Hong Kong (CN)

(72) Inventor: Leroy L. Peterson, Omaha, NE (US)

(73) Assignee: SDS Asia Limited, BVI #1748971, Hong Kong (HK)

( * ) Notice: Subject to any disclaimer, the term of this patent is extended or adjusted under 35 U.S.C. 154(b) by 0 days. days.

(21) Appl. No.: 15/224,352

(22) Filed: Jul. 29, 2016

(51) Int. Cl.
*B63B 35/74* (2006.01)
*B63C 9/08* (2006.01)
*B63B 21/56* (2006.01)

(52) U.S. Cl.
CPC ..... *B63B 35/74* (2013.01); *B63B 21/56* (2013.01); *B63C 9/08* (2013.01)

(58) Field of Classification Search
CPC .. B63B 7/08; B63B 7/00; B63B 35/73; B63B 35/74; B63B 35/78; B63B 35/00; B63C 2009/042; B63C 9/08; B63C 9/30
USPC ..... 114/345, 363; 441/129, 130; 5/120
See application file for complete search history.

(56) References Cited

U.S. PATENT DOCUMENTS 5,046,978 A * 9/1991 Howerton ..... B63B 35/76 114/345
5,335,675 A * 8/1994 Wheeler ..... A61F 6/04 128/842
6,010,382 A * 1/2000 Kennedy ..... B63B 7/085 441/131
6,257,943 B1 * 7/2001 Peterson ..... B63B 35/76 114/345
6,623,322 B1 * 9/2003 Lesniak ..... B63B 7/085 114/345
6,931,678 B2 * 8/2005 Boyd ..... B63B 35/73 441/129
8,047,886 B1 * 11/2011 McLarty ..... B63B 35/74 114/346
2008/0207068 A1 * 8/2008 Rockstad ..... B63B 7/08 441/66

* cited by examiner

*Primary Examiner* — Lars A Olson
(74) *Attorney, Agent, or Firm* — Suiter Swantz pc llo

(57) ABSTRACT

A cockpit assembly for providing enhanced traction and stability for an inflatable material is disclosed. The cockpit assembly includes a cavity defined partially by the inflatable material, a support structure suspended within the cavity, and a cover material configured to cover the cavity. The inflatable material defines portion of side walls of the cavity. The support structure may be configured to be free of any contact with a bottom surface of the cavity and the cover material in a relaxed state.

18 Claims, 9 Drawing Sheets

COCKPIT ASSEMBLIES FOR TOWABLES

TECHNICAL FIELD

The disclosure generally relates to the field of inflatable devices, particularly to cockpit assemblies for towables.

BACKGROUND

Various types of recreational aquatic activities have long been popular with children and adults alike. Floatation devices such as deck tubes and the like have been utilized in some of these activities. Some of these floatation devices may be inflatable and towable. However, existing towables provide limited seat support for the users.

SUMMARY

Embodiments of the present disclosure are directed to cockpit assemblies. A cockpit assembly may include a cavity defined at least partially by an inflatable material. The cockpit assembly may also include a support structure suspended within the cavity. The cockpit assembly may further include a cover material configured to cover the cavity.

Embodiments of the present disclosure are also directed to towables. A towable may include an airtight inflatable material. The towable may also include a cavity defined at least partially by the airtight inflatable material. The towable may further include a support structure suspended within the cavity and a cover material configured to cover the cavity.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1A:
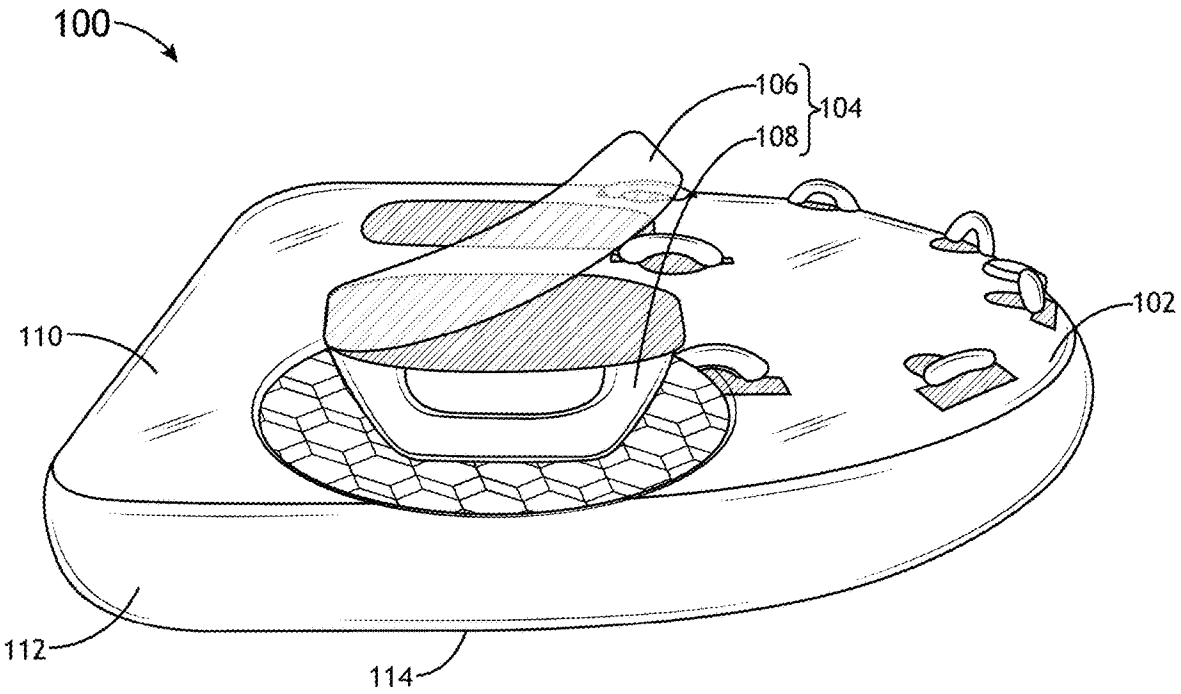
FIG. 1A is an illustration depicting a cockpit assembly of a towable.

Reference will now be made in detail to the subject matter disclosed, which is illustrated in the accompanying drawings.

The present disclosure is directed to a cockpit assembly (may also be referred to as a seating arrangement) suitable for various aquatic activities. More specifically, the cockpit assembly in accordance with the present disclosure provides users/riders with a seat structure capable of supporting multiple individuals in lying, sitting, or kneeling position on water during the ride.

Referring generally to FIGS. 1A through 7, a towable 100 including an inflatable material 102 (may also be referred to as the airtight inflatable material) having a cockpit assembly 104 fixedly positioned inside a cavity of the inflatable material 102 is shown. One or more users/riders can ride on the towable 100. As the user(s)/rider(s) sit, lay, or kneel over the cockpit assembly 104 of the inflatable material 102, a UV-treated material 106 (may also be referred to as the cover material) which covers the internal support structure 108 (may also be referred to as the support structure) provides a more secure riding option on water and the internal support structure 108 support user(s)/rider(s) weights more efficient than the conventional inflatable devices on the market. The present disclosure allows user(s)/rider(s) to position themselves securely during the ride and change riding postures with relative ease.

Now referring to FIG. 1A, the towable 100 in accordance with the present disclosure may include the inflatable material 102 which defines a top surface 110, a side surface 112, a bottom portion 114, and a cavity where a cockpit assembly 104 is installed. The cockpit assembly 104 includes a UV-treated material 106 which covers the internal support structure 108. It is understood that the inflatable material 102 may be made of various types of flexible materials such as plastics or the like. The inflatable material 102 may be formed using one or more fabricated pieces joined together. The specific material and process utilized for producing the inflatable material 102 including the top surface 110, the side surface 112, and the bottom portion 114 may vary without departing from the spirit and scope of the present disclosure. In addition, due to the nature of the floating tube being inflatable, it is contemplated that certain corners/edges/sides may be rounded or curved when inflated.

Figure 1B:
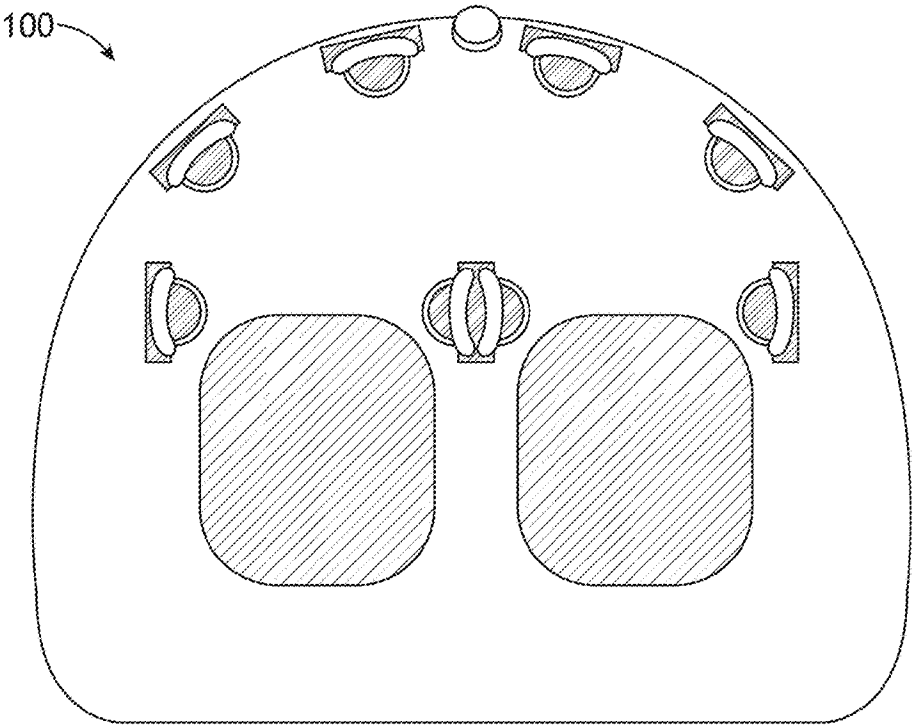
FIG. 1B is a top view of the towable depicted in FIG. 1A.
Figure 1C:
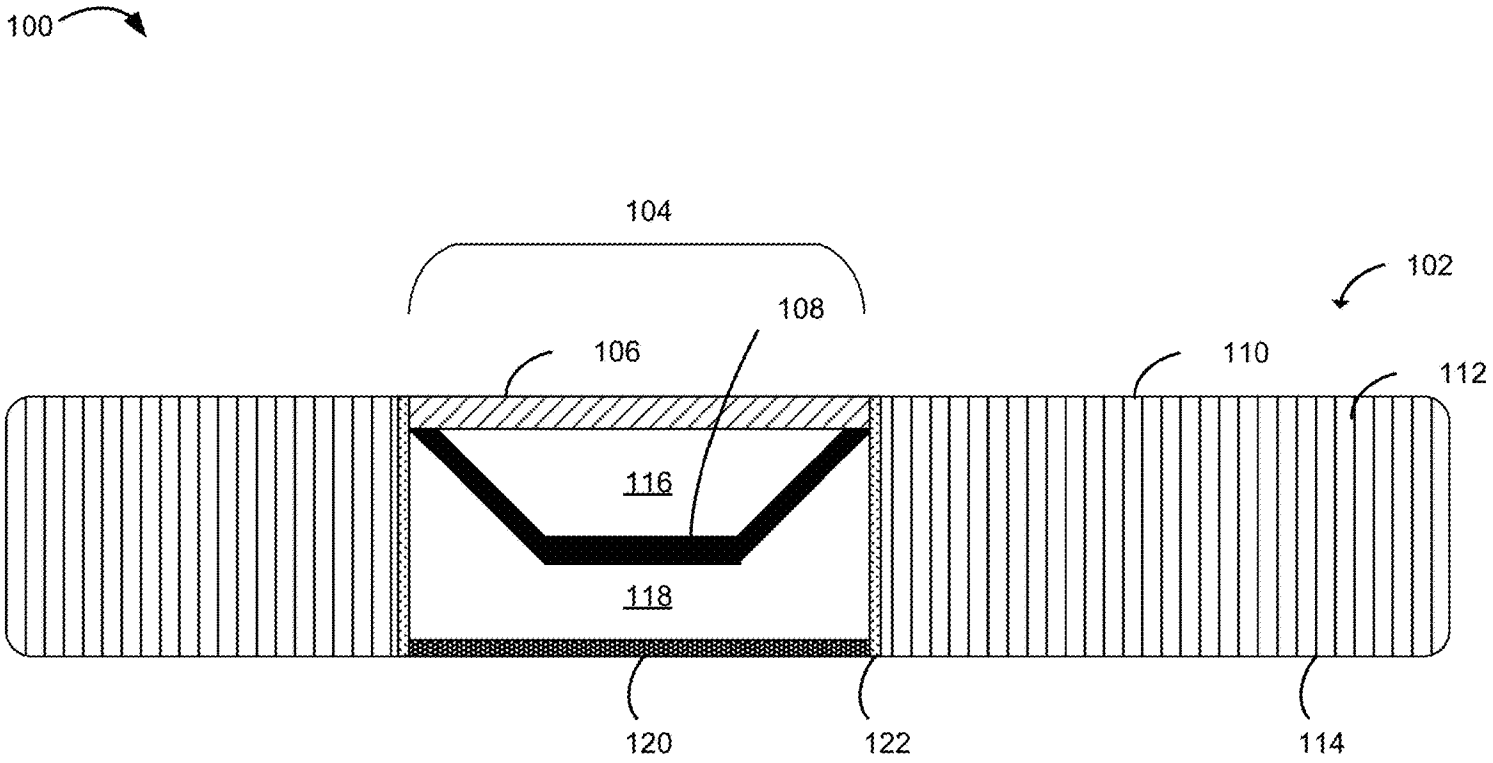
FIG. 1C is a cross-sectional side view of the towable depicted in FIG. 1A.

Now referring to FIGS. 1B and 1C of top view and cross-sectional view of the towable depicted in FIG. 1A, respectively, the towable 100 in accordance with the present disclosure may define a cavity housing the cockpit assembly 104 where rider(s) position themselves into the towable 100. The cockpit assembly 104 includes a UV-treated material 106 providing user(s)/rider(s) with a stable riding experience on water. The UV-treated material 106 may be formed from a stretchable material. For example, the UV-treated material 106 may be stretchable in 4 ways. By way of another example, the UV-treated material 106 may be formed form polyester-polyurethane copolymer material (also known as Lycra which is a brand name for spandex and a trademark of INVISTA). In general, the material formed from polyester-polyurethane copolymer may be stretchable up to 5 times of its length. The specific material and process utilized for producing the UV-treated material 106 may vary without departing from the spirit and scope of the present disclosure. In this regard, the UV-treated material 106 may help reduce users'/riders' physical impacts during the ride. Furthermore, the UV-treated material 106 may provide a traction stability to surfaces of the cockpit assembly 104 so as to prevent user(s)/rider(s) from sliding forward or off during the ride. Additionally, the UV-treated material 106 may be securely disposed on the top surface 110 of the inflatable material 102 with a coupling methods (e.g., heat welded or otherwise joined together) known in the art so as to cover the internal support structure 108. It is noted that when user(s)/rider(s) sit in the surface of the cockpit assembly 104 the UV-treated material 106 may take a shape of the cavity of the cockpit assembly 104 until the user's/rider's body reaches the internal support structure 108.

In some embodiments, the cockpit assembly 104 may include the internal support structure 108 configured to be generally fitted inside of the cavity created by the inflatable material 102. For example, the internal support structure 108 may provide a seating space for a user/rider to securely sit in the towable 100. Furthermore, the internal support structure 108 may be a suspended structure where the internal support structure 108 is positioned to define two air gaps above (116) and below (118) the internal support structure 108 as shown in FIG. 1C. In this regard, the suspended internal support structure 108 may help distribute user's/rider's weight(s) evenly as well as keep user(s)/rider(s) from hitting their bottom portions of a body on the water. The two air gaps (116 and 118) may act as a shock absorber for the suspended internal support structure 108. This feature may provide additional riding comfort to the users/riders. It is noted that the bottom of the suspended internal support structure 108 may not be contacted with a Nylon fabric 120 (may also be referred to as the bottom surface) of the bottom portion 114 of the inflatable material 102 in a relaxed state. It is further noted that a top of the suspended internal support structure 108 may not be in contact with the UV-treated material 106 in the relaxed state. The relaxed state can be defined as a state where no external forces are applied to the cockpit assembly 104. It is contemplated that while the Nylon fabric 120 described above is configured as non-inflatable, such a configuration is merely exemplary. Alternative embodiment of the present disclosure may include the Nylon fabric 120 configured as inflatable to further offer additional seat support.

In some embodiments, the internal support structure 108 may be formed from a piece of heavy-duty materials. For example, the internal support structure 108 may be formed from one or more pieces of heavy duty Nylon fabric. The specific material and process utilized for producing the internal support structure 108 may vary without departing from the spirit and scope of the present disclosure. Furthermore, a circumference of the heavy duty fabric of the internal support structure 108 may be sewn entirely or partially onto side walls 122 of the inflatable material 102 in order to provide the suspended structure of the internal support structure 108 described above. It is contemplated that while the internal support structure 108 described above is coupled by sewing such a configuration is merely exemplary. Other methods of coupling one or more pieces of heavy duty fabric such as gluing, hot melting, hot welding, or the like may also be utilized.

It is contemplated that while the internal support structure 108 described above is configured as concave cavity from the cross-sectional view (i.e., FIG. 1) such a configuration is merely exemplary. Other shapes of the internal support structure 108 such as convex or the like may also be utilized. Additionally, the internal support structure 108 may be formed from the same material as the inflatable material 102.

Figures 2A, 2B, 2C, 2D, 2E:
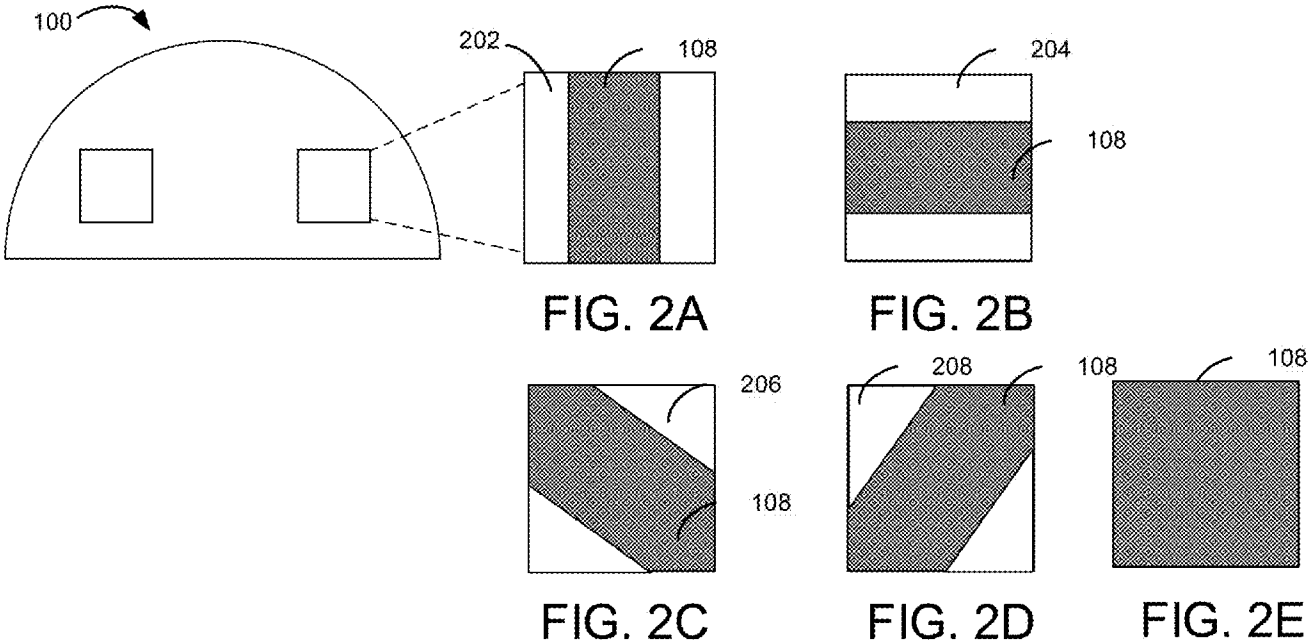
FIG. 2A is an illustration depicting alternative arrangement of an internal support structure in a cockpit assembly.
FIG. 2B is an illustration depicting alternative arrangement of the internal support structure in the cockpit assembly.
FIG. 2C is an illustration depicting alternative arrangement of the internal support structure in the cockpit assembly.
FIG. 2D is an illustration depicting alternative arrangement of the internal support structure in the cockpit assembly.
FIG. 2E is an illustration depicting alternative arrangement of the internal support structure in the cockpit assembly.

It is further contemplated that various arrangements of the internal support structure 108 may be utilized for the cockpit assembly 104, as illustrated in FIG. 2A through 2E. For instance, arrangements of the internal support structure 108 may include an arrangement with open spaces 202 on the sides as shown in FIG. 2A. However, other arrangements of the internal support structure 108 may also be utilized. Exemplary arrangements of the internal support structure 108 may include, but not limited to, a horizontal arrangement with open spaces 204 as shown in FIG. 2B, a diagonal from upper left to lower right arrangement with open spaces 206 as shown in FIG. 2C, a diagonal from upper right to lower left arrangement with open spaces 208 as shown in FIG. 2D, and an arrangement without any open space as shown in FIG. 2E, as well as other arrangements of the internal support structure 108 without departing from the spirit and scope of the present disclosure.

Figure 3:
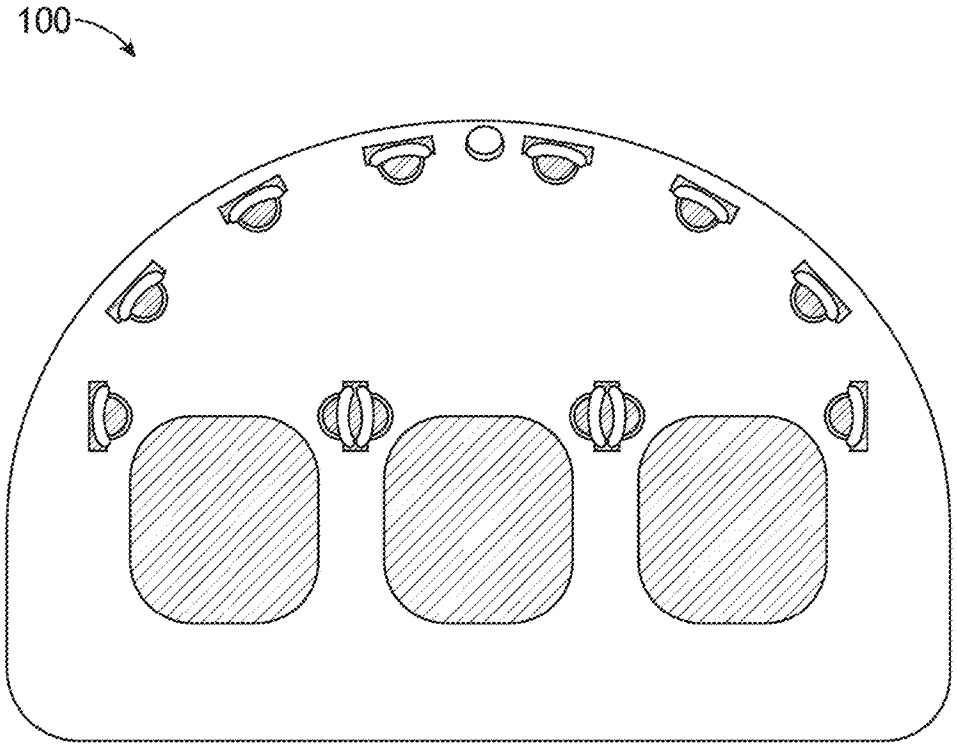
FIG. 3 is an illustration of three riders towable.

The towable 100 in accordance with the present disclosure may be formed in several different size configurations. For instance, multi-person (e.g., 2 or 3 person) sizes may be produced for adults as shown in FIG. 3 as well as kids (not shown). Other sizes of the towable 100 may be formed without departing from the spirit and scope of the present disclosure.

Figure 4:
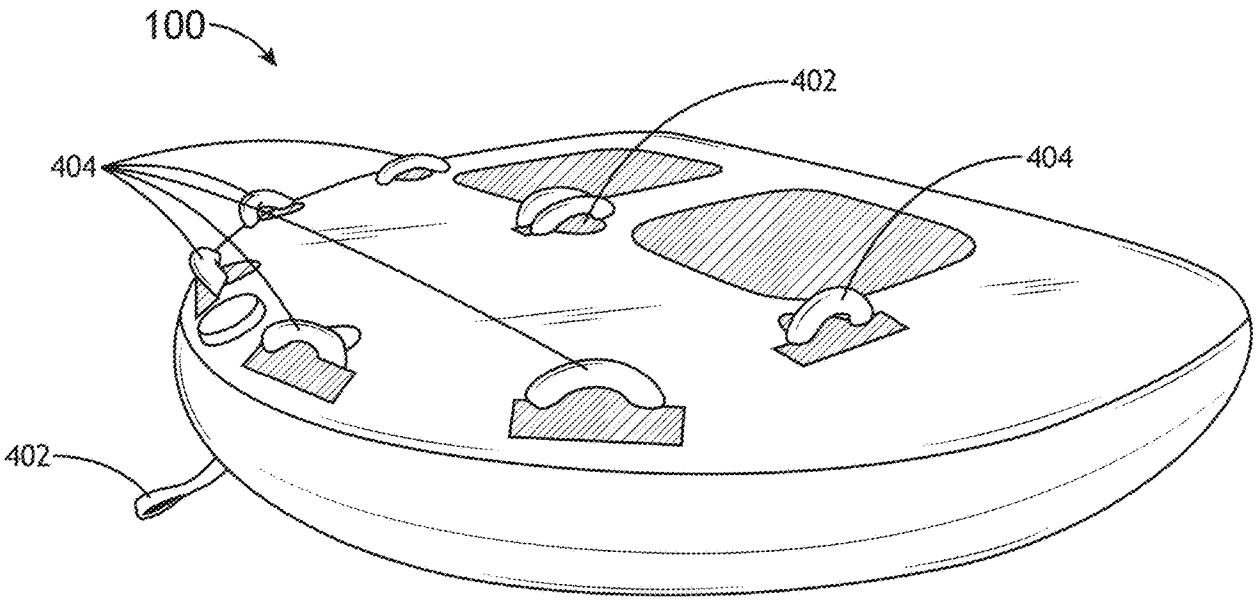
FIG. 4 is an illustration of the towable with a tow attachment and hand grips or handles.

It is noted that the towable 100 in accordance with the present disclosure includes a tow attachment point 402 as shown in FIG. 4 which allows user(s)/rider(s) to tow the towable 100 with a boat, ship, watercraft, sail, yacht, car, truck or the like. For example, the tow attachment point 402 may be located on the front bottom surface of the towable 100 so that a tow rope (not shown) attached securely to the tow attachment point 402 exerts a force pulling the towable 100.

In some embodiments, a plurality of hand grips or handles 404 are provided to the towable 100 to allow user(s)/rider(s) to hold onto the towable 100 during the ride as shown in FIG. 4. For example, the hand grips or handles 404 may be positioned at locations close to where user(s)/rider(s) would be positioned when laying/sitting/kneeling in the towable. The hand grips or handles 404 may be positioned along the top surface 110 of the front perimeter of the towable 100 to allow user(s)/rider(s) to hold onto the towable 100 when laying down. By way of another example, the hand grips or handles 406 may be positioned adjacent to the cockpit assembly 104 so as to allow user(s)/rider(s) to hold onto the towable 100 when sitting down or kneeling in. Additionally, the hand grips or handles 404 may be positioned in front of the towable 100 so as to allow the use(s)/rider(s) to pull the hand grips or handles 404 to assist in lifting or moving the towable 100 out of the water or into the water.

Figure 5:
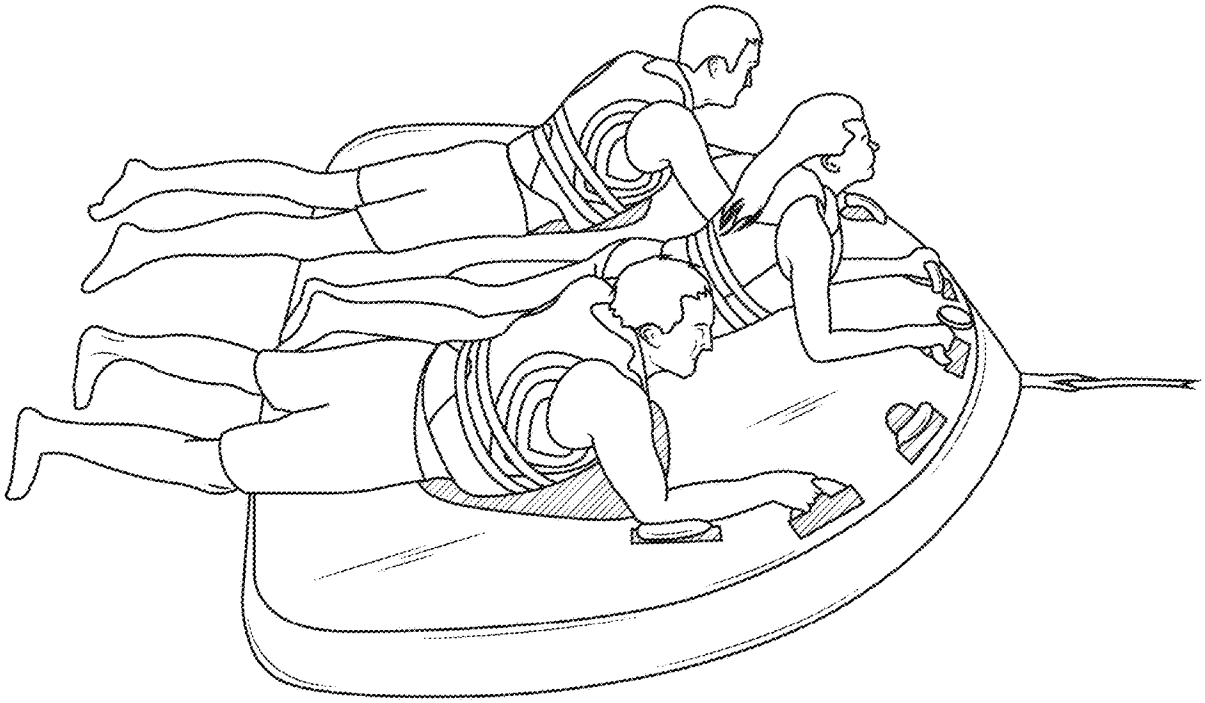
FIG. 5 is a partial isomeric view illustrating alternative type of riding postures.
Figure 6:
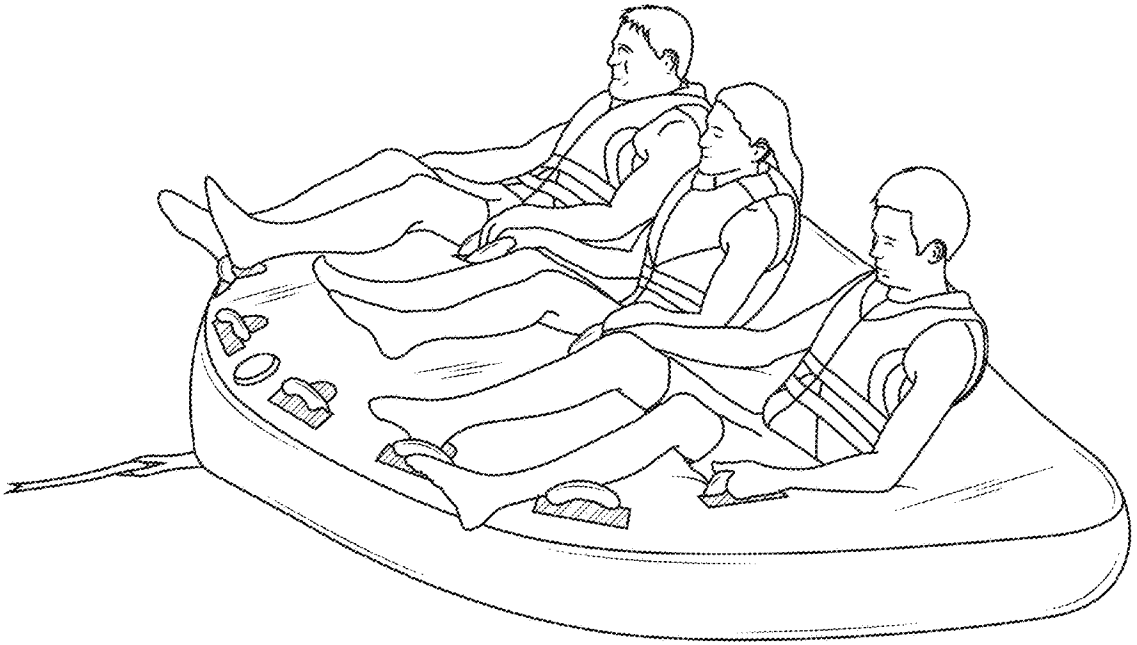
FIG. 6 is a partial isomeric view illustrating alternative type of riding postures.
Figure 7:
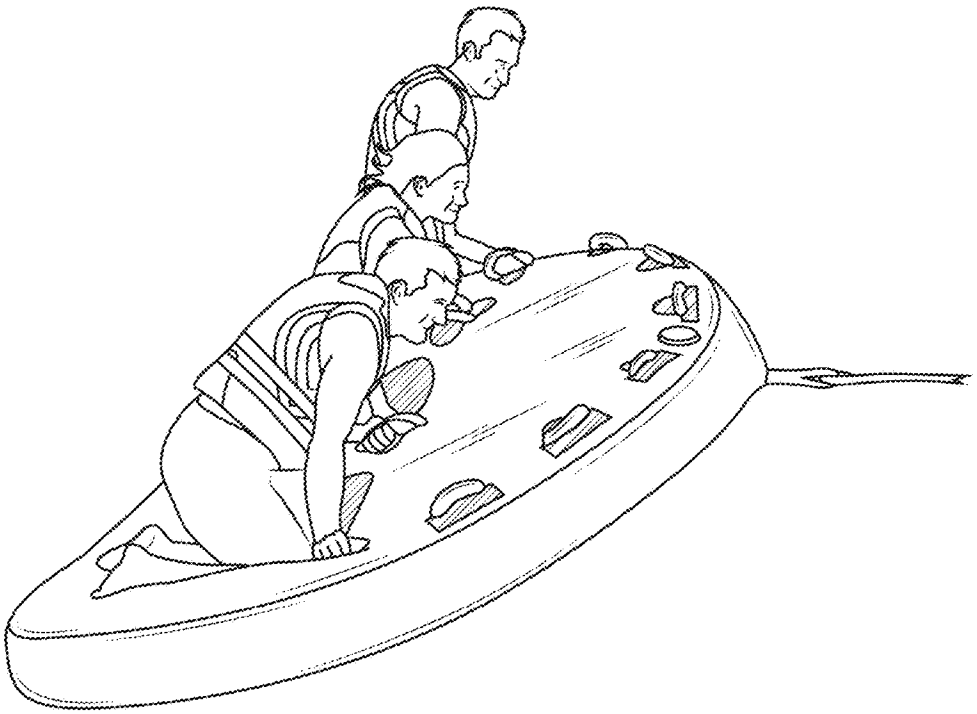
FIG. 7 is a partial isomeric view illustrating alternative type of riding postures.

It is contemplated that various types of riding postures may be achievable for the towable 100, as illustrated in FIGS. 5 through 7. For instance, riding postures may include a laying down position where the UV-treated material 106 allows for a comfortable riding position as shown in the FIG. 5. However, other types of riding postures may also be achievable. Exemplary riding posture may include, but not limited to, a sitting down position where this position allows user(s)/rider(s) to sit more securely due to the presence of the cockpit assembly 104 as shown in FIG. 6, a kneeling position where user(s)/rider(s) can enjoy riding on whips and turns as shown in FIG. 7, as well as other types of riding postures without departing from the spirit and scope of the present disclosure. The riding posture choices described above improve the industry standard of towables giving the user(s)/rider(s) more secure riding options.

It is noted that the towable 100 in accordance with the present disclosure allows the user(s)/rider(s) to securely position themselves into the cockpit assembly 104. While the ability to comfortably and securely ride when the towable 100 floats on water is referenced in the examples above, it is contemplated that the towable 100 in accordance with the present disclosure may be utilized in various other types of surfaces such as on land, snow, ice or the like.

It is further contemplated that the main body of the towable 100 is not limited to a D-shape. Various different shapes may be utilized without departing from the spirit and scope of the present disclosure. That is, the main body of the towable 100 may be configured as any hollow chamber that allows one or more person to sit/kneel/lay inside the cockpit assembly 104.

It is also noted that the inflatable feature of the towable 100 in accordance of the present disclosure allows the towable 100 to be deflated for storage. When deflated, the towable 100 may be folded or rolled-up, and therefore compact and easy to carry around.

The various components of the towable 100 in accordance with the present disclosure may be formed using various types of materials. For instance, various types of flexible materials such as plastics (e.g., polyvinyl chloride, thermoplastic polyurethane, etc.), fabrics, or the like may be utilized. The towable 100 may be formed using one or more fabricated pieces joined together. The specific material and process utilized for producing the towable 100 may vary without departing from the spirit and scope of the present disclosure. In addition, due to the nature of the towable 100 being inflatable, it is contemplated that certain corners/edges/sides may be rounded or curved when the towable 100 inflated.

It is understood that the present disclosure is not limited to any underlying implementing technology. The present disclosure may be implemented using a variety of technologies without departing from the scope and spirit of the invention or without sacrificing all of its material advantages.

It is believed that the present disclosure and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A cockpit assembly, comprising:

a cavity defined at least partially by an inflatable material;

a support structure suspended within the cavity; and a stretchable cover material configured to cover the cavity, the stretchable cover material configured to be free of any contact with support structure in a relaxed state, wherein, when a body of a user is on top of the stretchable cover material, the stretchable cover material is further configured to stretch into the cavity until the stretchable cover material reaches the support structure, wherein the support structure is configured to be free of any contact with the bottom surface of the cavity in the relaxed state.

2. The cockpit assembly of claim 1, wherein the inflatable material defines at least a portion of side walls of the cavity.

3. The cockpit assembly of claim 1, wherein a bottom surface of the cavity is non-inflatable.

4. The cockpit assembly of claim 1, wherein the support structure is configured to be free of any contact with the stretchable cover material in the relaxed state.

5. The cockpit assembly of claim 1, wherein the support structure is coupled with at least a portion of side walls of the cavity.

6. The cockpit assembly of claim 1, wherein the support structure is formed using Nylon.

7. The cockpit assembly of claim 1, wherein the stretchable cover material is formed using polyester-polyurethane copolymer.

8. An apparatus, comprising:

an airtight inflatable material;

a cavity defined at least partially by the airtight inflatable material;

a support structure suspended within the cavity; and a stretchable cover material configured to cover the cavity, the stretchable cover material configured to be free of any contact with support structure in a relaxed state, wherein, when a body of a user is on top of the stretchable cover material, the stretchable cover material is further configured to stretch into the cavity until the stretchable cover material reaches the support structure, wherein the support structure is configured to be free of any contact with the bottom surface of the cavity in the relaxed state.

9. The apparatus of claim 8, wherein the airtight inflatable material defines at least a portion of side walls of the cavity.

10. The apparatus of claim 8, wherein a bottom surface of the cavity is non-inflatable.

11. The apparatus of claim 8, wherein the support structure is configured to be free of any contact with the stretchable cover material in the relaxed state.

12. The apparatus of claim 8, wherein the support structure is coupled with at least a portion of side walls of the cavity.

13. The apparatus of claim 8, wherein the support structure is formed using Nylon.

14. The apparatus of claim 8, wherein the stretchable cover material is formed using polyester-polyurethane copolymer.

15. An apparatus, comprising:

an airtight inflatable material, wherein the airtight inflatable material defines at least a portion of side walls of a cavity;

the cavity defined at least partially by the airtight inflatable material;

a support structure suspended within the cavity, wherein the support structure is configured to be free of any contact with the bottom surface of the cavity in a relaxed state and be free of any contact with a stretchable cover material in the relaxed state; and the stretchable cover material configured to cover the cavity, wherein, when a body of a user is on top of the stretchable cover material, the stretchable cover material is further configured to stretch into the cavity until the stretchable cover material reaches the support structure.

16. The apparatus of claim 15, wherein the support structure is coupled with at least a portion of side walls of the cavity.

17. The apparatus of claim 15, wherein the support structure is formed using Nylon.

18. The apparatus of claim 15, wherein the stretchable cover material is formed using polyester-polyurethane copolymer.

* * * * *